United States Patent [19]

Barnard

[11] Patent Number: 4,989,993

[45] Date of Patent: Feb. 5, 1991

[54] CARTON LOOK PLASTIC BAG WITH EAR HANDLES

[76] Inventor: Delbert J. Barnard, 33315 - 5th Pl. SW., Federal Way, Wash. 98023

[21] Appl. No.: 377,339

[22] Filed: Jul. 6, 1989

Related U.S. Application Data

[62] Division of Ser. No. 286,454, Dec. 19, 1988, Pat. No. 4,877,335.

[51] Int. Cl.[5] ..... B65D 33/08

[52] U.S. Cl. ..... 383/6; 383/7; 383/10; 383/17; 383/903

[58] Field of Search ..... 383/6, 7, 8, 10, 17, 383/21, 903

[56] References Cited

U.S. PATENT DOCUMENTS

| | | | |
|---|---|---|---|
| 1,524,399 | 1/1925 | Krueger | 383/21 X |
| 3,567,110 | 3/1971 | Susuki et al. | 383/6 X |
| 4,125,220 | 11/1978 | Suominen | 383/9 |

FOREIGN PATENT DOCUMENTS

| | | | |
|---|---|---|---|
| 7181 | 1/1980 | European Pat. Off. | 383/17 |
| 3644618 | 7/1988 | Fed. Rep. of Germany | 383/7 |
| 3644620 | 7/1988 | Fed. Rep. of Germany | 383/7 |

*Primary Examiner*—George E. Lowrance
*Assistant Examiner*—Jes F. Pascua
*Attorney, Agent, or Firm*—Delbert J. Barnard

[57] ABSTRACT

A bottom filled, top gusset plastic bag (10, 106) includes a pair of flexible ear handles (24, 26 or 130, 132). The handles include circular hand-receiving openings (76 or 134) and have circular outlines and circular transition regions (78, 80 or 136, 138) are provided between the ear handles (24, 26 or 130, 132) and attached base portions of the handles. The circular hand-receiving openings (76 or 134) and the curved transition regions (78, 80 or 136, 138) function to distribute weight forces substantially across the full width of each side of a filled bag (10, 106).

4 Claims, 6 Drawing Sheets

Fig. 3
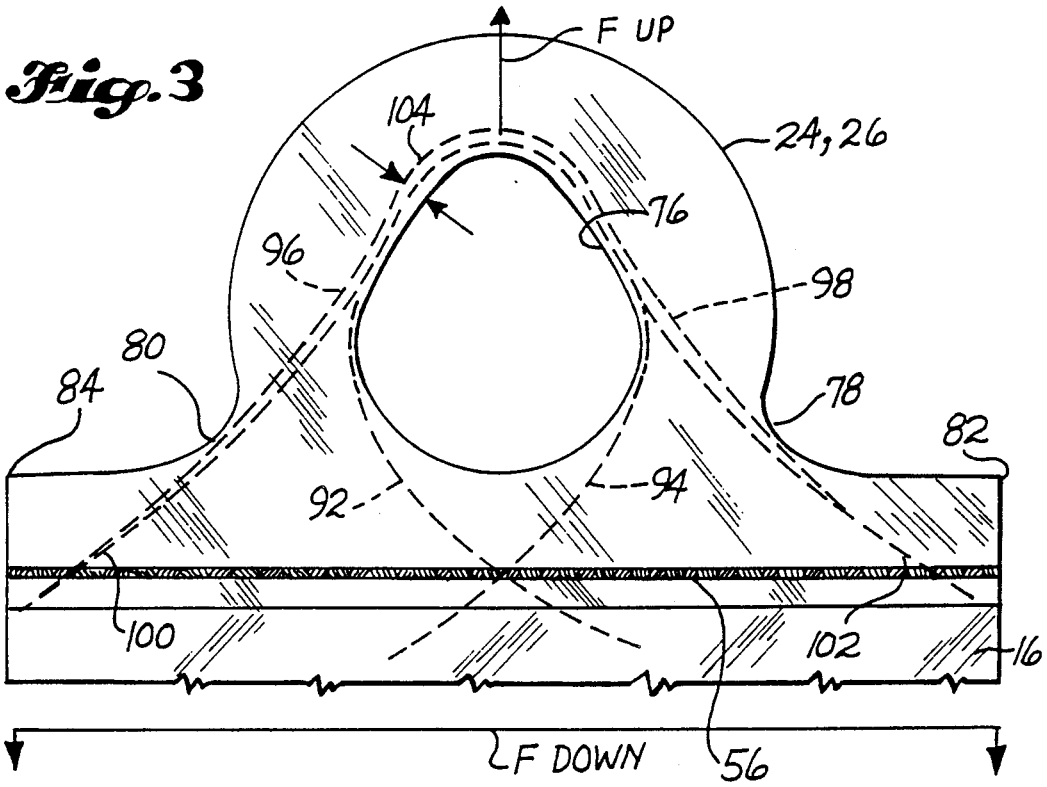
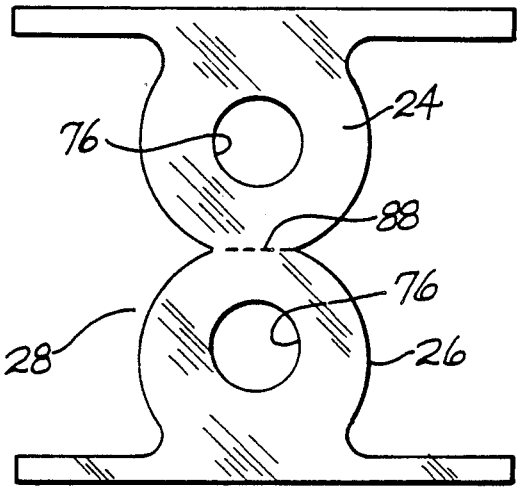
Fig. 8
Fig. 7
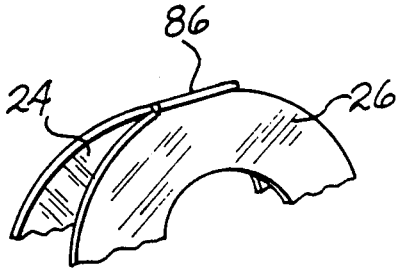
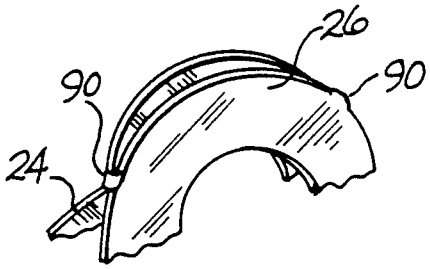
Fig. 9

Fig. 10
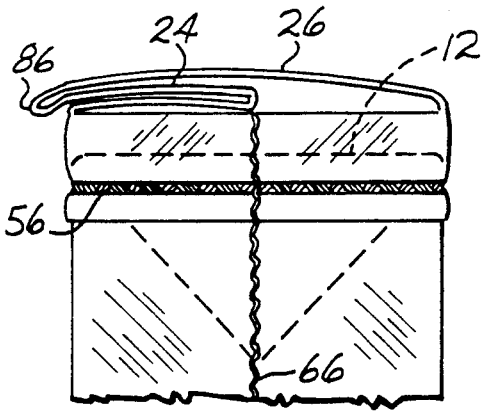
Fig. 11
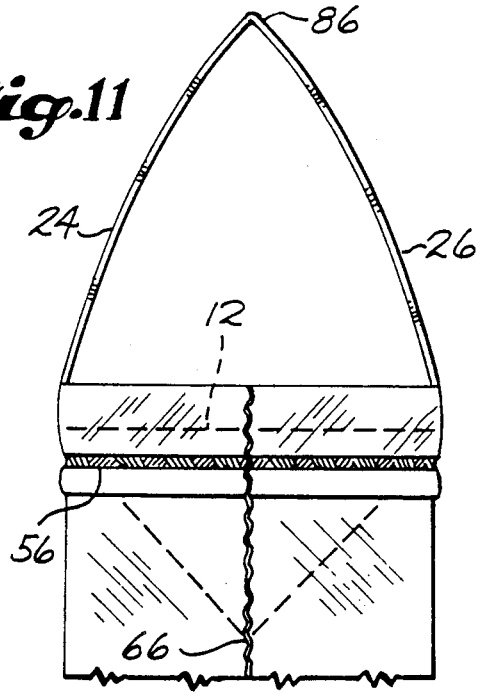
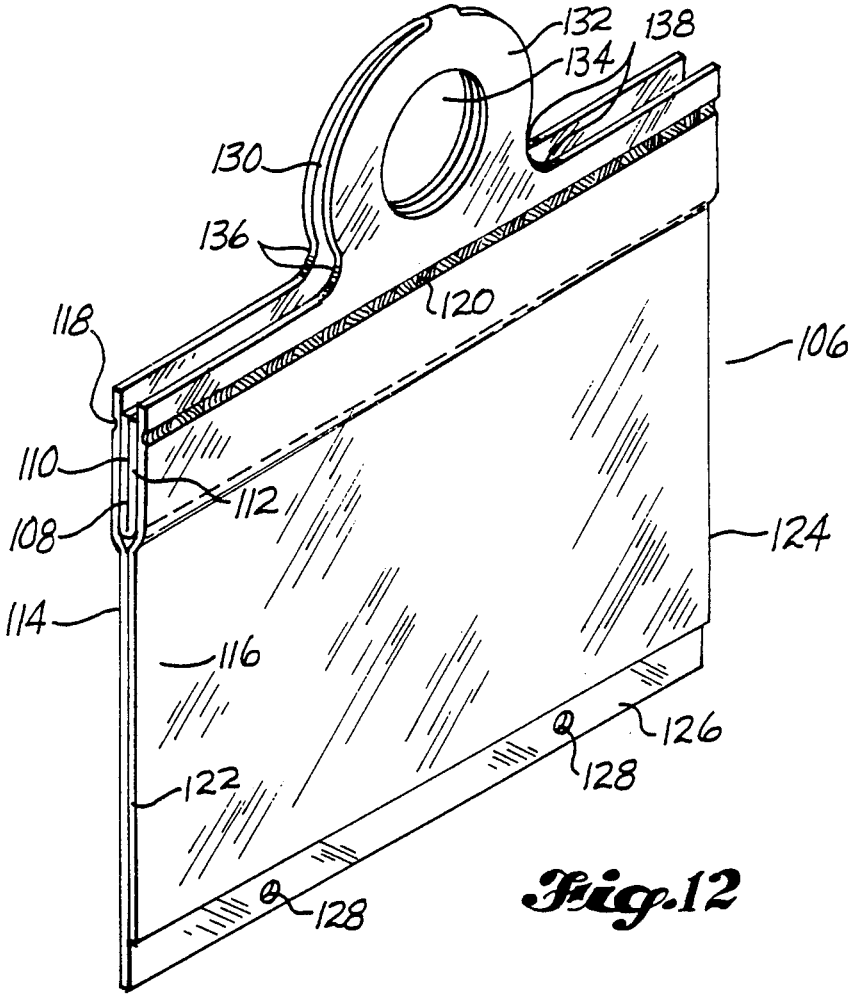
Fig. 12

CARTON LOOK PLASTIC BAG WITH EAR HANDLES

This application is a division of application Ser. No. 07/286,454, filed Dec. 19, 1988, now U.S. Pat. No. 4,877,335.

TECHNICAL FIELD

This invention relates to bottom loaded plastic bags which have a closed top and a "carton" look when filled. More particularly, it relates to the provision of this type of bag with an improved carrying handle.

BACKGROUND ART

Cubic bag packages which simulate a carton have become quite popular for packaging disposable infant diapers and adult briefs These bags make it possible to create the "carton" look with a similar degree of packaging line automation, but with a much reduced material cost. The bag offers nearly one hundred percent surface availability for graphics, a perfectly contoured fit, and additional features such as add-on carrying handles Also, the filled bags are readily stackable. A good background description of these bags appears in the article entitled "Poly Bag Packaging For Disposable And NonWoven Products," by A. G. Thatcher, published Mar. 15, 1977, in Montreal, Canada. Reprints of this article are available from Technomic Publishing Co., Inc. of Westport, Conn.

A popular form of "cubic" bag, equipped with a "loop" type carrying handle, is disclosed by German Patent Publication No. 2,155,091, published May 10, 1972. This same bag and handle are disclosed in U.S. Pat. No. 3,370,630, granted Feb. 27, 1968, except that the bag is not shown in a full packed condition and the top of the bag is not accurately drawn French Patent Publication No. 2,053,590, published on Apr. 16, 1971, also relates to a cubic bag and discloses three styles of carrying handles, each of which has opposite side portions which are heat sealed to the bag where the gusset meets the front and rear walls of the bag.

It is known to heat seal a handle web to a bag web and then cut the handle web to form the desired handle shape. German Patent Publication No. 2,157,072, published June 7, 1973, discloses the use of this method in the manufacture of a flat bag. U.S. Pat. No. 4,573,203, granted Feb. 25, 1986, to Harry R. Peppiatt, discloses the use of this method for providing a loop handle at the gusset end of a cubic bag.

U.S. Pat. No. 4,539,705, granted Sept. 3, 1985, to Patrick A. Baines discloses a cubic bag having a strap-like handle which extends lengthwise of the gusset. The ends of the handle are connected to the endwalls of the filled bag. This patent sets forth a very comprehensive description of the various types of cubic bags which have been used for packaging disposable diapers and similar products.

U.S. Pat. No. 3,240,420, granted March 15, 1966, to John N. Membrino, and Canadian Pat. No. 907,574, granted Aug. 15, 1972, to Herbert F. Gurband disclose bags which are manufactured to include both a gusset and handle portions at an upper end of the bag. This particular construction is undesirable because it requires the use of an extremely wide web of plastic material Also, the elongated grip hand holes which are illustrated create stress concentrations and undesirable and unsightly wrinkling of the bag material.

U.S. Pat. No. 3,567,110, granted Mar. 2, 1971, to Rinnosuke Susuki, discloses a bottom-loaded plastic bag which has a closed top and a pair of grip handles on the opposite side of the bag. The grip handles of this bag are constructed from a relatively thick plastic This permits the use of elongated hand receiving openings without undesirable wrinkling or stress concentrations The thick handles function as beams and thus it is the stiffness of the handle material which provides good weight distribution between the bag and handles.

The principal object of the present invention is to provide a bottom-loaded cubic bag, for use to package disposable diapers and similar products, having flexible ear handles on the opposite sides of the bag, with a configuration which provides good stress distribution between bag and handle and a pleasing appearance both when the handles are stowed and when they are in use.

DISCLOSURE OF THE INVENTION

Plastic bags of the present invention are basically characterized by front and rear panels, a top gusset between the panels at one end of the bag, and a fill opening at the opposite end of the bag. The panels and the gusset are connected together such that when the bag is filled, it will assume a substantially hexahedral shape. The bag of the invention includes ear handles on opposite sides. Each ear handle includes a substantially circular hand-receiving opening and a base portion which extends substantially the full width of the filled bag. A transitional region of the handle material extends between each ear handle and the corner region of a filled bag which is of a shape to establish a stress boundary extending substantially to the corner of the bag. Preferably, the circular hand-receiving openings are positioned so as to create stress boundaries below the openings which curve toward each other and intersect each other within an upper region of the sidewalls of the bag.

In preferred form, the ear handles are generally circular in outline shape and the generally circular outline is substantially concentric with the substantially circular hand-receiving openings.

According to the invention, the ear handles may be initially connected together by an easily breakable connection. This connection holds the ear handles together until they are pulled apart by a user.

According to the invention, the handles may be add-on handles, with the gusset being an integral part of the side panels of the bag Or, the gusset may be a false gusset and the handles may be integral upward extensions of the side panels of the bag.

Other objects, features and advantages of the invention will be hereinafter described in detail as a part of the description of the best mode of the invention.

BRIEF DESCRIPTION OF THE DRAWINGS

In the drawings, like reference numerals are used to designate like parts throughout the several views, and:

FIG. 3 is a fragmentary side elevational view of an upper portion of a filled bag in the process of being carried by the handle and showing the stress pattern in the material;

FIG. 7 is a fragmentary pictorial view showing one manner of initially connecting the ear handles together at the upper boundaries of the ear handles;

FIG. 8 is a plan view showing a cut handle web for a single bag opened and placed in a single plane;

FIG. 9 is a view like FIG. 7, but showing the ear handles initially connected together by tack welds;

FIG. 10 is a fragmentary end elevational view showing the ear handles folded down on top of the filled bag;

FIG. 11 is a view like FIG. 10, but with the ear handles substantially raised and still connected;

FIG. 12 is a view like FIG. 2, but of a second embodiment of the invention having ear handles integral with the bag sidewalls and a false gusset;

BEST MODE FOR CARRYING OUT THE INVENTION

Figure 1:
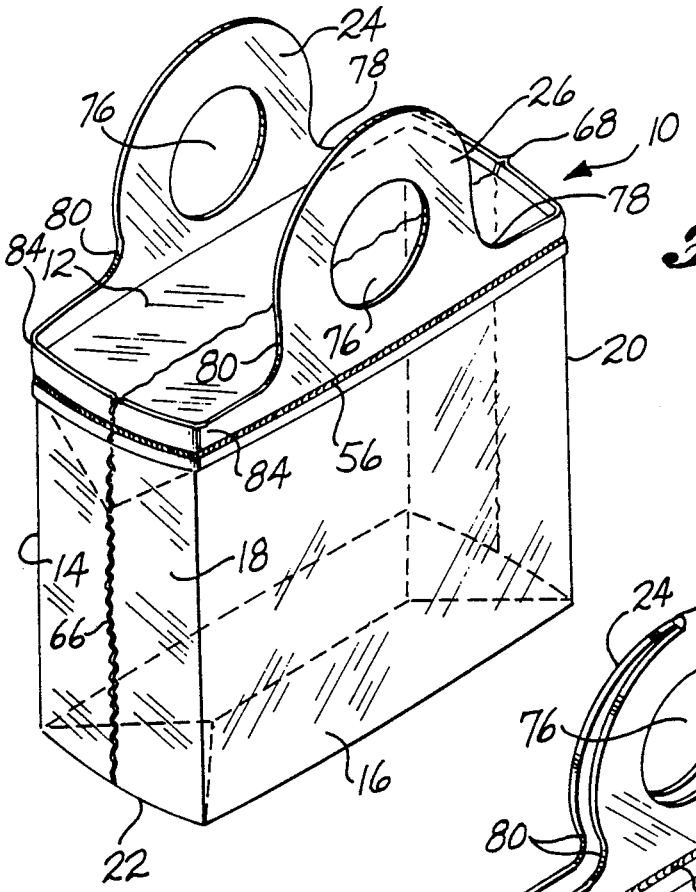
FIG. 1 is a pictorial view of a filled first embodiment of the invention, said view being taken from above and looking towards the top, one end and one side of the bag, and showing the ear handles spaced apart and extending upwardly, for clarity of illustration.
Figure 2:
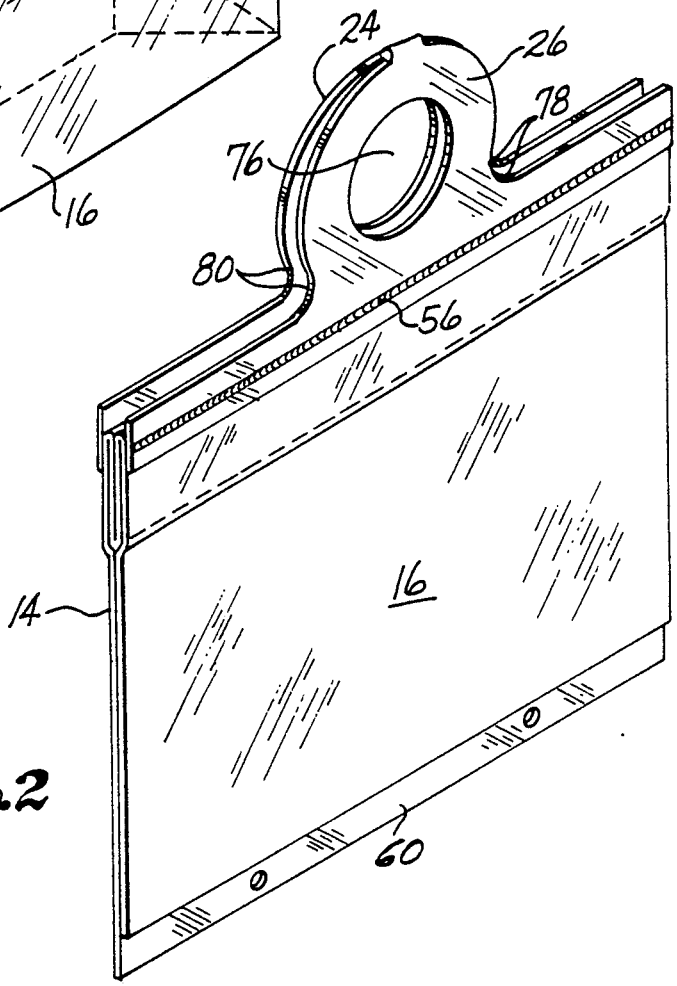
FIG. 2 is a pictorial view of the bag shown by FIG. 1, in an initially flat, unfilled condition.

Referring to FIG. 1, bag 10 is shown to comprise a top 12, sides 14, 16, ends 18, 20, a bottom 22, and a pair of ear handles 24, 26. The basic bag construction is well known and has become a popular package for disposable diapers. The bag is constructed from flexible thermoplastic material and owing to its construction, it assumes a substantially hexahedral shape when filled. For this reason, bags of this type have been referred to in the trade as "carton look" bags.

Figure 6:
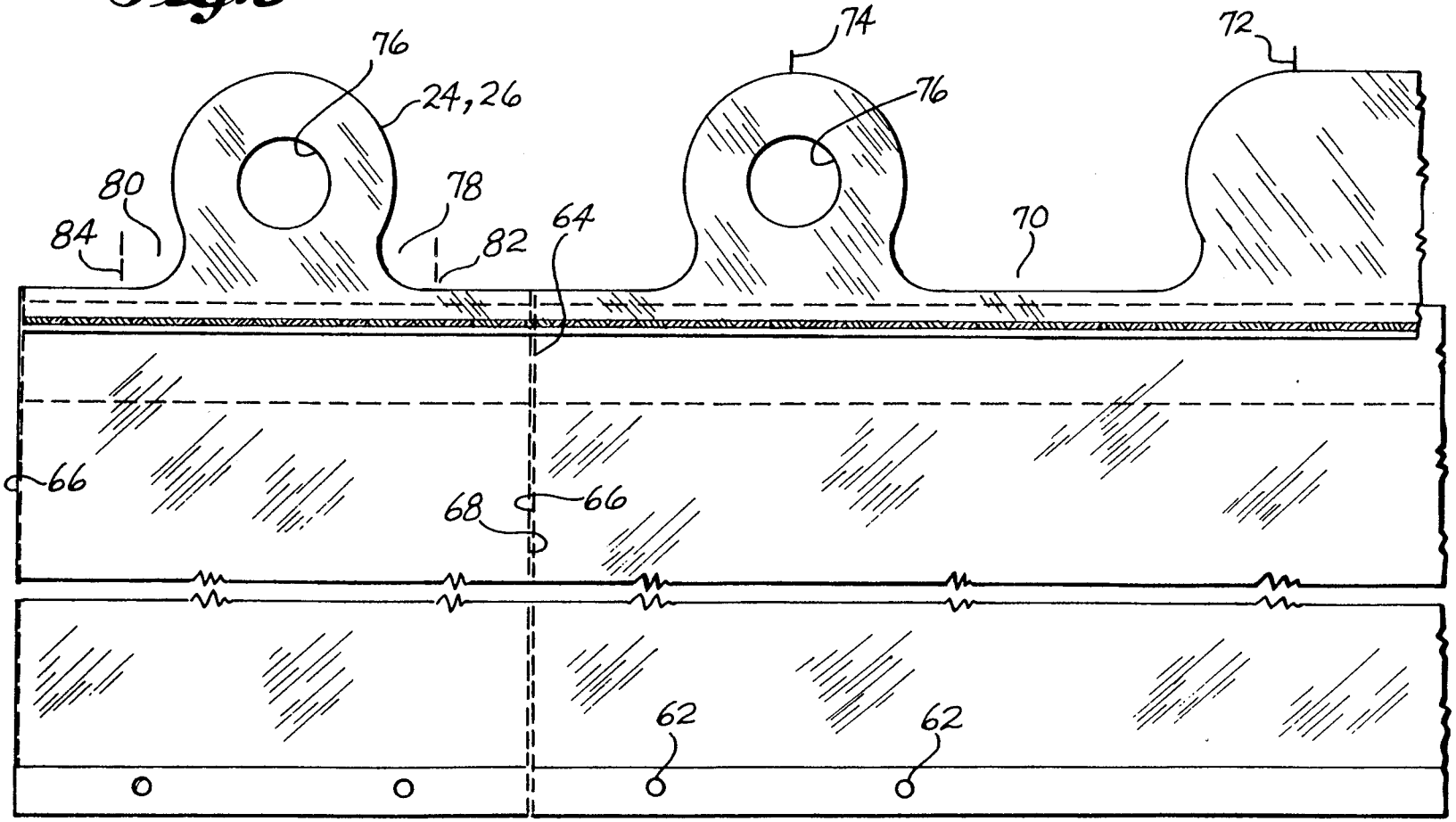
FIG. 6 is a plan view of the joined-together handle and bag webs, and showing the handle web cut to form the ear handles.
Figure 5:
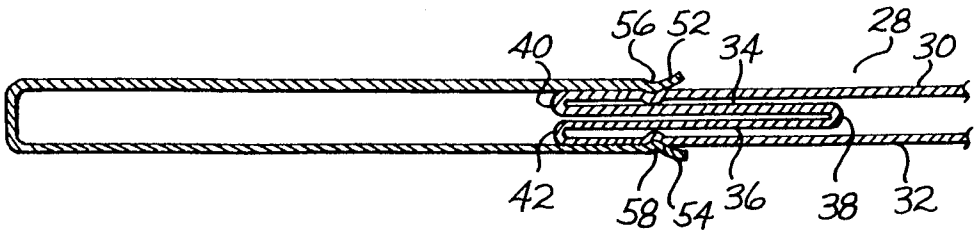
FIG. 5 is a sectional view taken substantially along line 5—5 of FIG. 4.
Figure 4:
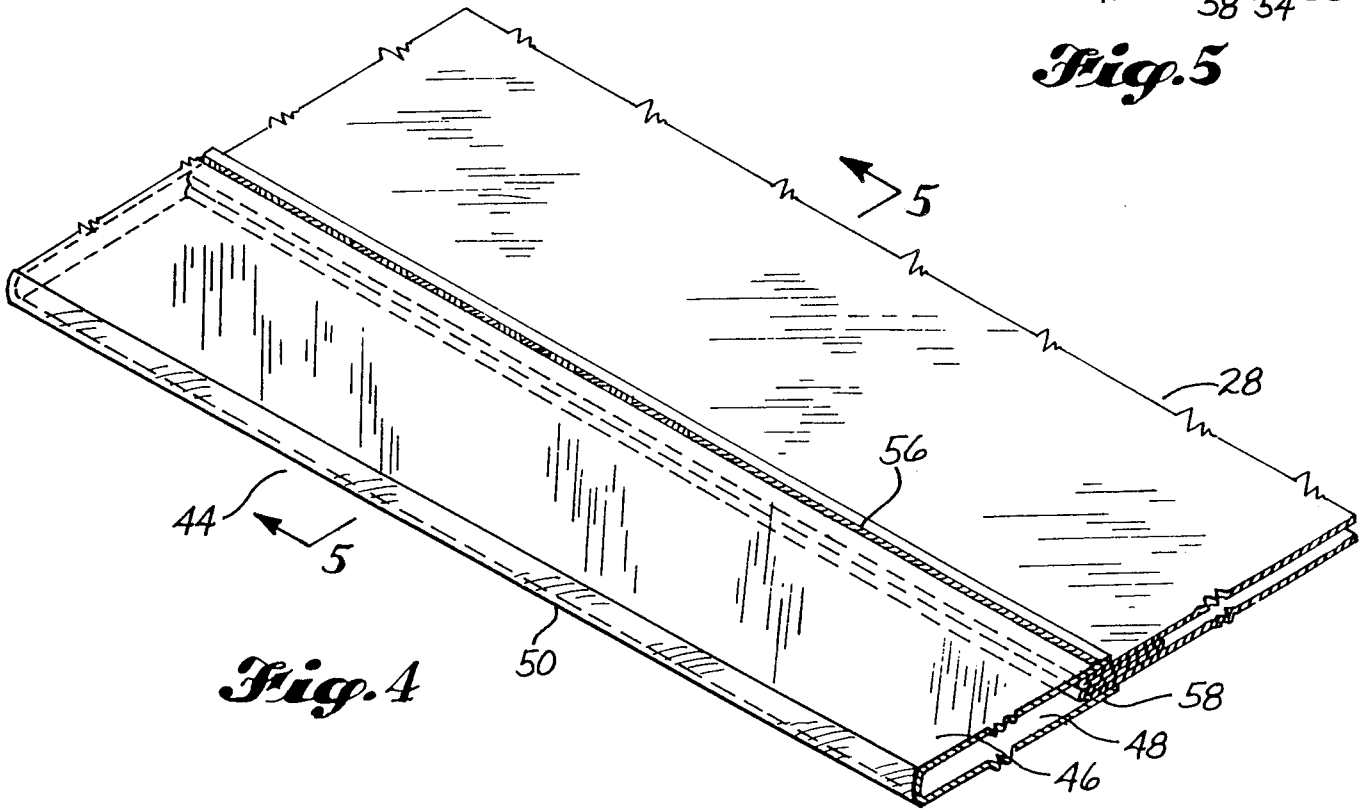
FIG. 4 is a fragmentary pictorial view showing the folded handle web attached to the folded bag web.

Referring to FIGS. 4–6, in the manufacture of the bag, a bag web 28 of thermoplastic material is folded laterally on itself to form a closed boundary and an open boundary. Then, the closed boundary is folded inwardly so as to give the web 28 a substantially "M" shape in cross section at the closed boundary (FIGS. 4 and 5). This folding of the web 28 produces front and rear bag panels 30, 32, gusset panels 34, 36, a gusset centerline fold 38, and gusset outer boundary folds 40, 42.

A handle web 44 is folded laterally on itself to define handle web panels 46, 48, a fold 50, and attachment edge portions 52, 54. As best shown by FIG. 5, the attachment edge portions 52, 54 are positioned contiguous upper outer portions of the bag webs 30, 32 and are then heat sealed to the bag webs 30, 32, by means of seals 56, 58 which extend longitudinally of the webs 28, 44. The webs 28, 44 are heat welded together while they are traveling through the bag making machine. Following attachment, the attached webs 28, 24 are intermittently stopped and while stopped the handle shape is cut, wicket pin openings are punched and then individual bags 10 are delineated. The web 28 is folded so as to create a lip 60 at the open boundary The wicket pin openings 62 are punched in this lip 60. To delineate a bag 10, the attached webs 28, 44 are cut along a cut line 64 by a heated cutter which at the same time creates bag side seals 66, 68 on the opposite sides of the cut line 64.

The side seals 66, 68 are parallel to each other and extend perpendicular to the webs 28, 44 and the seals 56, 58. Each bag 10 is filled through an opening defined by and between the panels 30, 32 at the end of the bag opposite the gusset. Owing to the method of manufacture, the side seals 66, 68 connect the side edges of the bag panels 30, 32 together and in the gusset region also connect the end edges of the gusset panels 34, 36 together and to the side edges of the bag panels 30, 32. Owing to this construction, when the bag is filled and the open end is closed the bag 10 naturally assumes the shape of a hexahedron.

Referring to FIG. 6, a single cut-out 70 may be made to define the handle edge shape between points 72, 74. This cut-out 70 is made when the connected webs 28, 44 are stopped. The cut-out 70 can be made by use of a heated knife, a punch, a traveling blade, etc. Hand-receiving openings 76 are also cut or punched while the bag webs 28, 44 are stopped.

According to the invention, the hand-receiving openings 76 are substantially circular. Preferably, the ear handles 24, 26 have a substantially circular outline shape which is substantially concentric with the hand-receiving openings 76. More importantly, transitional curves 78, 80 are provided in the regions of the handle panels on opposite sides of the ear handles 24, 26. In FIG. 6, these transitional regions 78, 80 are shown to extend from the ear handles 24, 26 substantially to locations 82, 84 which substantially coincide with the upper corners of the bag 10 when filled.

The bag web 28 is preferably a food grade polyethylene film and may be either laminated or single ply. Laminated construction is preferred because it protects the printing. A laminate comprises an opaque inner ply which is printed and a transparent outer ply which overlies the printing and is bonded to the inner ply. The handle web 44 may be a clear material and is preferably also polyethylene. Both webs 28, 44 are quite flexible.

In FIG. 1, the ear handles 24, 26 are shown extending upwardly from the bag 10. However, owing to the flexible nature of the material, if not supported, the ear handles 24, 26 would tend to collapse onto the top 12 of the bag. According to an aspect of the invention, the ear handles 24, 26 are initially attached together so that they are together rather than separate when in a folded condition on top of the package 10. In this regard, reference is made to FIGS. 10 and 11. FIG. 10 ,shows the handles 24, 26 connected together at 86. It also shows handle 24 folded and spaced slightly above the package top 12. Handle 26 is shown in a substantially flat condition overlying the folded handle 24 and the portion of the package top 12 adjacent to it. Of course, it could be handle 26 which is folded and on the bottom and handle 24 which is substantially flat and on the top. The spacing is for clarity of illustration. In actuality, there is no space and the folded handle lies on one half of the top 12 and the other handle lies on the folded handle and the second half of the top 12.

FIG. 11 shows the handles 24, 26 moved upwardly above the package top 12, while remaining connected at location 86. The connection 86 may be a short uncut region of the fold 50. It may also be a longer uncut region of the fold 50 which has been perforated (at 88 in FIG. 8) or nicked so that it can be easily parted when it is desired to separate the handles 24, 26. Alternatively, the handles 24, 26 may be completely cut apart during the manufacturing process and then tack welded together at one or more locations. Two tack welds 90 are illustrated in FIG. 9 at upper side locations of the handles 24, 26. The location of the tack welds 90 may be further down, e.g. at the fold ends of the folded underneath handle (FIG. 10), and the number of tack welds may vary.

FIG. 3 shows a lifting force "F UP" being exerted on the handles 24, 26, by use of the hand-receiving openings 24, 26. The force down "F DOWN" is also indicated. Owing to the use of circular hand-receiving openings 76, and the transitional curves 78, 80, there is a wide distribution of the lifting force to the seals 56, 58 even though the handle material use is flexible and incapable of functioning as a beam. As shown by FIG. 3, when the bag is lifted, the openings 76 are stretched into a substantially egg shape. A stress boundary exists in the material surrounding the upper portions of the openings 76. Below the openings 76, the stress boundaries extend towards each other, substantially along lines 92, 94. Outer stress boundaries 96, 98 extend from the material above the openings 76 down to a tangent with the transitional curves 78, 80 and then curve outwardly generally along lines 100, 102. The width of the stressed zone 104 is a variable, depending in large part on the weight of the goods in the package. In the example illustrated in FIG. 3, the bag weight is distributed to substantially the full width of the bag sides 14, 16, and in the side regions of the bag, substantially the full length of the seals 56, 58 is utilized for distributing the weight forces between the bag and handle. The use of substantially circular opening 76 creates the inwardly curving stress boundaries 92, 94. With this design, the opening 76 can be properly sized and positioned above the heat seals 56, 58 so as to cause the stress boundaries 92, 94 to cross each other above the level of the heat seals 56, 58. When this happens, essentially the full seal 56, 58 is being utilized on each side of the filled bag.

The material upwardly bordering the upper portions of the hand-receiving openings 76 becomes stressed and wrinkled somewhat when the bag is used The wrinkles appear in the form of circles concentric with the opening outline. The construction of the ear handles 24, 26 to have a circular outer edge outline that is substantially concentric with the hand-receiving openings 76 sufficiently masks any adverse appearance effect of the semicircular wrinkles in the handle material The wrinkles are concentric with the hand-receiving opening 76 and with the outer edges of the handles 24, 26, and thus the wrinkles merely appear to be a part of the handle design Thus, they do not have an undesirable appearance. Also, the circular outline of the handles 24, 26 provides a pleasing appearance both when the handles are folded and resting on top of the bag (FIG. 10) and when they are in use for carrying the bag.

Figure 13:
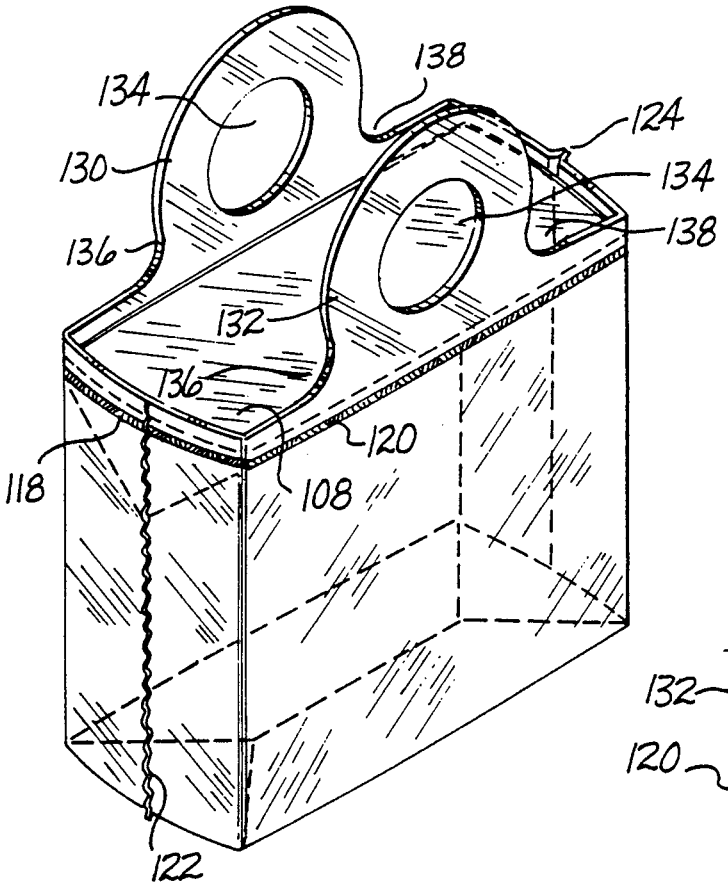
FIG. 13 is a view like FIG. 1, but of the embodiment of FIG. 12 in a filled condition.
Figure 14:
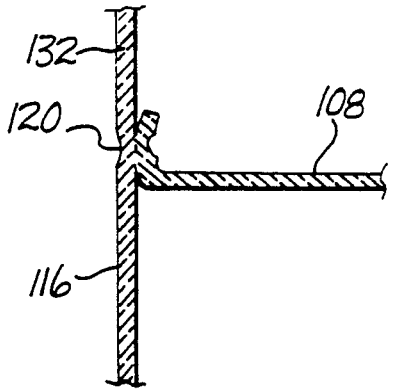
FIG. 14 is an enlarged scale fragmentary sectional view showing the connection of an edge portion of the false gusset to a sidewall of the bag.

FIGS. 12–14 illustrate a modified construction of the bag. In these figures, the bag is designated 106. Its basic construction is the same as bag 10 except that the gusset 108 is a false gusset. It is constructed from a separate piece of material and in the manufacturing process each opposite edge portion 110, 112 is heat welded to the bag side panels 114, 116 along heat seals 118, 120. The heat seals 118, 120 extend perpendicular to the side seams 122, 124. As in the earlier design, bag panel 114 is slightly wider than bag panel 116, so as to form a lip 126. Wicket pin openings 128 are formed in the lip 126. Bag 106 is further characterized by having handles 130, 132 which are integral portions of the bag panels 114, 116. In other respects, the handles 130, 132 are identical to the handles 24, 26. They are provided with substantially circular hand-receiving openings 134 and they have a substantially circular outer edge shape which is concentric with the openings 134. Also, transitional curves 136, 138 are provided between the handles 130, 132 and the attached base portions of the handles The use of circular hand-receiving openings 134 function to distribute the carrying stresses substantially along the full side width of each bag. The use of the circular openings 134 in combination with the circular transitional edges 136, 138 results in a minimizing of slack in the bag material in the central region of the bag below the opening 134, and thus minimizes the formation of wrinkles in a filled bag which has been rather snugly packed. An advantage of using a false gusset 108 and making the handles 130, 132 from upper portions of the bag panels 114, 116 is that the bag weight is not transmitted through the seals 118, 120 As a result, the seals can be made smaller and their construction is not as critical as it would be if they were to carry the bag weight. Also, the puckered skirt of an add-on handle is eliminated. The narrow border portion of the false gusset 108 is positioned inside of the panels 114, 116 and is therefore substantially concealed. As shown by FIG. 13, when the bag of FIG. 12 is filled through the bottom and the bottom closed, the bag assumes a substantially hexahedral shape.

If desired, the initial connection together of the handles 24, 26 or 130, 132 can be omitted. If the disclosed manufactured process is used for making the bag, the ear handles 24, 26 or 130, 132 will want to stay together and assume the folded relationship shown in FIG. 10, even if they are not initially connected together. If the handles 24, 26 or 130, 132 are initially connected together, the user may choose to pull them apart, if it is desired, to gain access to the bag 10 or 106 by means of opening the top 12 or 108.

Figure 15:
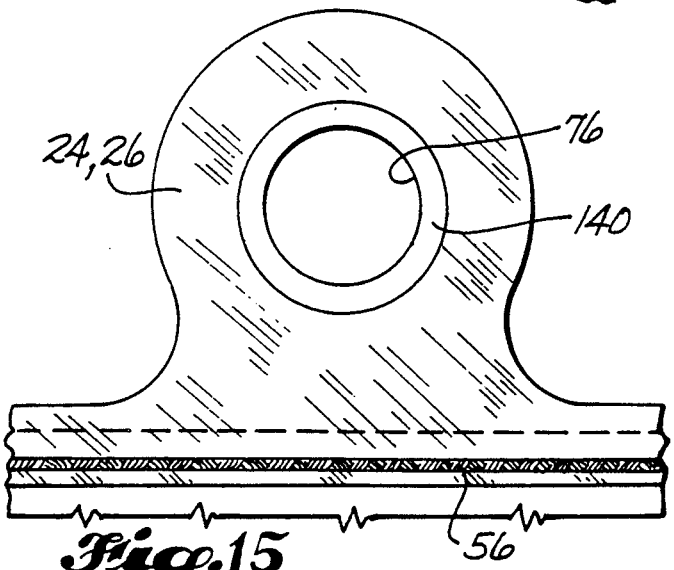
FIG. 15 is an enlarged scale fragmentary elevational view of an ear handle having a reinforced circular region surrounding the hand-receiving opening.

Referring to FIG. 15, ear handles 24, 26 (or 130, 132) may be provided with a circular reinforced region 140 surrounding the hand-receiving opening 76 (or 134). This region 140 may include an extra thickness of strong sheet material bonded to the handle material.

The embodiments which have been illustrated and described are presented by way of example only. The scope of protection is not to be directly limited by these examples, but rather is to be determined by the appended claims, interpreted in accordance with the established rules of patent claim interpretation, including use of the doctrine of equivalents.

What is claimed is:

1. A plastic bag, comprising:

a bag of thermoplastic material including front and rear bag panels, a top gusset panel between the bag panels at one end of the bag, and fill opening at the opposite end of the bag, said bag panels having parallel side edges, and said top gusset panel having end edges colinear with and positioned between upper portions of the side edges of the bag panels when the bag is flat and unfilled, and having substantially parallel side edges;

transverse seals connecting the side edges of the top gusset panel to the bag panels, and side seals connecting the side edges of the bag panels together, and further connecting the end edges of the top gusset panel together and to the upper portions of the side edges of the bag panels, in a manner resulting int he bag, when filled, assuming a substantially hexahedral shape and the top gusset panel forming a substantially closed top for the bag;

said bag when filled having four sidewalls and corners were the sidewalls meet;

handle panels of thermoplastic material, one on each side of the bag, said handle panels being one piece upper extensions of the front and rear bag panels, said handle panels having base portions contiguous to the side edges of the top gusset panel, and central ear handles extending from the base portions, said central ear handles being substantially identical in size and shape and including substantially circular hand-receiving openings;

said base portions of the handle panels extending the full width of the front and rear bag panels;

wherein in use the bag is filled through the fill opening and then the fill opening of the bag is sealed shut; and wherein when the filled bag is picked up by use of the handles upper stress boundaries are created in each handle panel, and said stress boundaries surround the hand-receiving openings at upper portions thereof and then extending downwardly and outwardly, towards the corners of the filled bag.

2. A plastic bag according to claim 1, wherein each ear handle has a generally circular outline which is substantially concentric with its substantially circular hand-receiving opening, and wherein on each side of the hand-receiving opening the generally circular outline merges into a transitional wire, and wherein the transitional wires are substantially convex-shaped and tangent to the upper stress boundaries.

3. A plastic bag according to claim 1 wherein the handle panels are opposite side portions of a web that has been folded on itself, and a breakable connection initially connects the ear handles together, and said breakable connection is a narrow connection between the two handle panels.

4. A plastic bag according to claim 1, comprising a breakable connection initially connecting the ear handles together, said breakable connection being at least one heat seal of narrow dimension connecting together edge portions of the ear handles.

* * * * *

UNITED STATES PATENT AND TRADEMARK OFFICE

CERTIFICATE OF CORRECTION

PATENT NO. : 4,989,993

DATED : February 5, 1991

INVENTOR(S) : Delbert J. Barnard

It is certified that error appears in the above-identified patent and that said Letters Patent is hereby corrected as shown below:

Column 1, line 17, there is a period after "briefs".
Column 1, lines 22 and 23, there is a period after "handles".
Column 1, line 36, there is a period after "drawn".
Column 2, line 3, there is a period after "plastic".
Column 2, line 5, there is a period after "concentrations".
Column 2, line 48, there is a period after "bag".
Column 5, line 14, "use" should be -- used --.
Column 5, line 41, there is a period after "used".
Column 5, line 47, there is a period after "material".
Column 5, line 50, there is a period after "design".
Column 6, line 7, there is a period after "handle".
Column 6, line 19, there is a period after "120".

Claim 1, column 6, line 68, "int he" should be -- in the --.

Claim 2, column 8, line 8, "wire" should be -- curve --; and line 9, "wires" should be -- curves --.

Signed and Sealed this

First Day of September, 1992

*Attest:*

*Attesting Officer*

DOUGLAS B. COMER

*Acting Commissioner of Patents and Trademarks*